US006224295B1

(12) United States Patent
Price et al.

(10) Patent No.: US 6,224,295 B1
(45) Date of Patent: May 1, 2001

(54) SOIL REINFORCEMENT

(76) Inventors: Derrick Ian Peter Price, 17B Ellington Road, Muswell Hill, London N10 3DD; Christopher Martin, 16 Kentish Gardens, Tunbridge Wells, Kent TN2 5XU, both of (GB)

( * ) Notice: Subject to any disclaimer, the term of this patent is extended or adjusted under 35 U.S.C. 154(b) by 0 days.

(21) Appl. No.: 09/242,128

(22) PCT Filed: Aug. 8, 1997

(86) PCT No.: PCT/GB97/02136

§ 371 Date: Mar. 30, 1999

§ 102(e) Date: Mar. 30, 1999

(87) PCT Pub. No.: WO98/06907

PCT Pub. Date: Feb. 19, 1998

(30) Foreign Application Priority Data

Aug. 9, 1996 (GB) ..... 9616761
Dec. 19, 1996 (GB) ..... 9626410

(51) Int. Cl.[7] ..... E02D 29/02
(52) U.S. Cl. ..... 405/262; 405/284; 405/286
(58) Field of Search ..... 405/262, 284, 405/285, 286

(56) References Cited

U.S. PATENT DOCUMENTS 4,616,959 10/1986 Hilfiker .
4,824,293 * 4/1989 Brown et al. ..... 405/262
5,044,834 * 9/1991 Janopaul, Jr. ..... 405/262
5,066,169 11/1991 Gavin et al. .
5,511,910 * 4/1996 Scales ..... 405/262
5,522,682 * 6/1996 Egan ..... 405/262
5,800,097 * 9/1998 Martin ..... 405/262
5,816,749 * 10/1998 Bailey, II ..... 405/284
5,839,855 * 11/1998 Anderson et al. ..... 405/262
5,975,809 * 11/1999 Taylor et al. ..... 405/262

FOREIGN PATENT DOCUMENTS 2199603 7/1988 (GB) .
9413890 6/1994 (WO) .

* cited by examiner

*Primary Examiner*—Eileen D. Lillis
*Assistant Examiner*—Frederick L. Lagman
(74) *Attorney, Agent, or Firm*—Dykema Gossett PLLC

(57) ABSTRACT

To secure a polymeric strip (5) to a facing (10) of a reinforced soil structure, the strip (5) is circumflected about a plastics rod (4) and the circumflected strip and the rod are interposed between two or more blocks (1, 2) in a cavity (7) to retain the rod and thereby secure the strip (5) to the facing (10). The location of the rod (4) within the facing serves to distribute more uniformly the load imposed by the facing (10) on the strip (5), and the plastics rod (4) is resistant to corrosion.

9 Claims, 7 Drawing Sheets

SOIL REINFORCEMENT

BACKGROUND OF THE INVENTION

This invention relates to reinforced soil structures, and it is particularly concerned with a method of and an apparatus for securing flexible polymeric strips to a facing for such a structure.

The technique of using polymeric strips in compacted granular fill behind a lightweight reinforced concrete facing is well known, and several ways of connecting the strips to the facing have been employed.

The present invention provides an assembly for use in reinforcing a soil structure comprising a polymeric strip secured to a facing by attachment means, characterised in that the attachment means comprise an elongate attachment member about which the strip is circumflected, and the facing comprises two or more blocks defining a cavity for receiving and retaining the member and a portion of the circumflected strip. The location of the attachment member within the facing serves to distribute more uniformly the load imposed on the facing by the strip. To improve its resistance to corrosion, the attachment member is preferably formed from non-metallic material.

Preferably, connecting means, which may be located in the cavity, are provided for interlinking the blocks. The connection means can be used to facilitate interlinking of the blocks, and also it may serve as a shear key between the blocks to resist shearing forces imposed on the facing when it is incorporated in a reinforced soil structure. The connection means may be provided integrally with one or more of the blocks, or as a separate element. Alternatively, the connection means and the attachment member may be integrally formed. The connection means may be formed from a non-metallic material.

In the preferred embodiment the cavity comprises a first recess disposed orthogonally to a second recess, the member is received and retained in the first recess and the depth of the first recess may be greater than that of the second recess to form a lip therebetween. The lip supports the adjacent portion of the attachment member to reduce substantially the bending moment imposed by the strip on the attachment member. Preferably the first recess and the lip are shaped to receive the attachment member and the circumflected portion of the strip. The attachment member may be held in position abutting the lip by the connection means. Preferably, the first recess is arranged laterally, and the second recess is disposed centrally, of the blocks.

The invention also provides a method of securing a polymeric strip of a reinforced soil structure to a facing therefor comprising a plurality of blocks, characterised by the steps of providing an elongate attachment member, circumflecting the strip about the member, providing two or more facing blocks defining a cavity for receiving the attachment member and a portion of the circumflected strip, and sandwiching the attachment member and the portion of the strip between the blocks in the cavity thereby to secure the strip relative to the facing.

Preferably a plurality of cavities and associated attachment members are provided, and one or more anchoring members are disposed in the soil structure, the method including the step of alternately circumflecting a continuous strip around an attachment member and an anchoring member.

A clear understanding of the invention will be gained from the following detailed description of embodiments thereof, given by way of example only, with reference to the accompanying drawings.

DETAILED DESCRIPTION OF THE PREFERRED EMBODIMENTS

Figure 1:
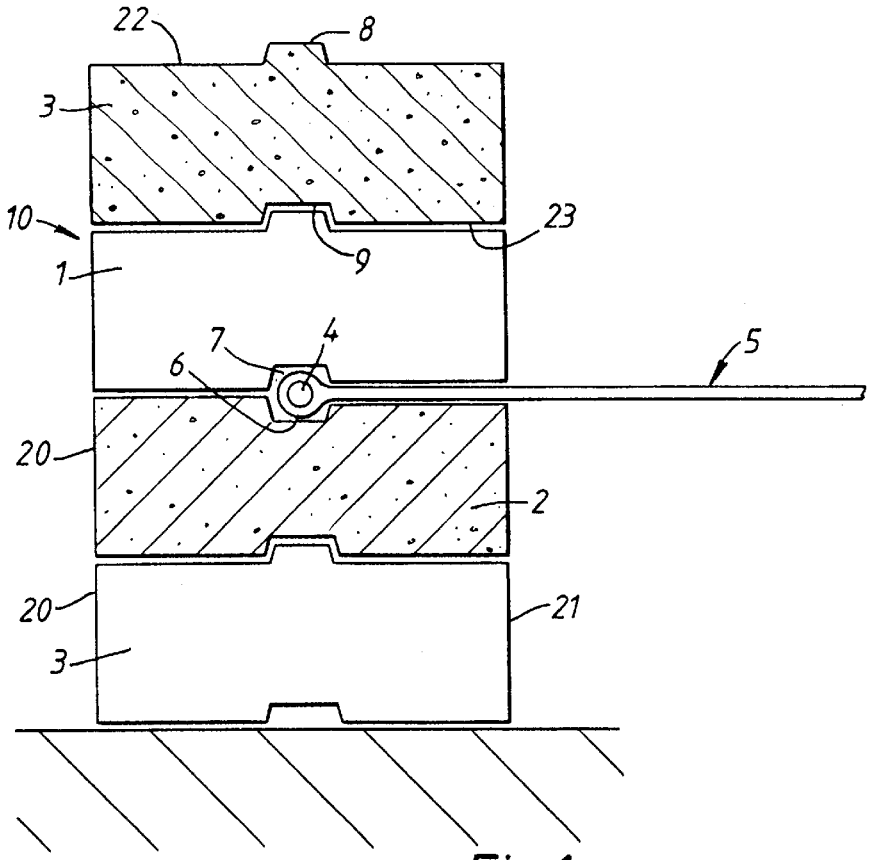
FIG. 1 is a sectional view through an embodiment of an assembly according to the invention.
Figure 2:
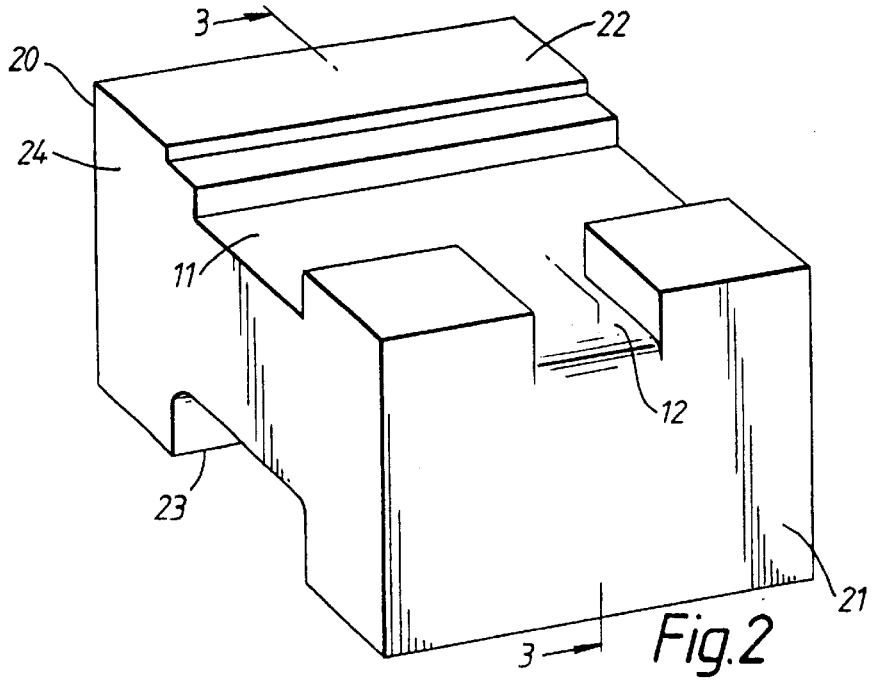
FIG. 2 is a perspective view of a lower block of the assembly of FIG. 1.

A facing for a reinforced soil structure, illustrated in FIG. 1, is assembled from generally parallelepiped concrete blocks or elements 1, 2 and 3 in rows. The blocks have front and rear faces 20, 21, and top, bottom and side walls 22, 23 and 24 respectively. Intermediate blocks 3 have a laterally extending projection 8 in the top wall 22 and a complementary channel in the bottom wall 23. Upper and lower connection blocks 1,2 are interposed between one or more intermediate blocks 3, and the surfaces of the top and bottom walls of the blocks 1,2 which are in abutment with the intermediate blocks are provided with projections 8 and channels 9 to interlink with the intermediate blocks 3. The facing could equally be formed with blocks having pairs of opposed projections and blocks having pairs of corresponding channels. The height of the facing is, of course, determined by the height of the structure and this determines the number of rows of strips required and therefore the number of intermediate blocks 3 between the assemblies of top and bottom blocks 1,2. Each block of each horizontal row of blocks is offset laterally from the adjacent rows when viewed in elevation.

An elongate plastics rod or beam 4 and a portion 6 of a polymeric strip 5, e.g. of , PARAWEB (trademark of Linear Composites Ltd., West Yorkshire, England, for flab webbing of polymeric sheath enclosed cores of polyester and aramid textile. Which is circumflected about the rod 4, are sandwiched in a cavity or compartment 7 defined between the top and bottom walls 22, 23 of the lower and upper blocks 2,1 respectively. The ends of the rod 4 extend laterally to either side of the strip.

The cavity 7 has a first recess 11 for the rod with the circumflected strip, defined by confronting lateral troughs in the upper and lower blocks 1,2, and a second recess 12 for the parts of the strip extending from the rod. The second recess is disposed orthogonally to the first recess 11, extends between the first recess and the rear wall 21, and is arranged centrally of the blocks. The front edge of the second recess may be rounded to avoid damage to the polymeric strip.

Figure 3:
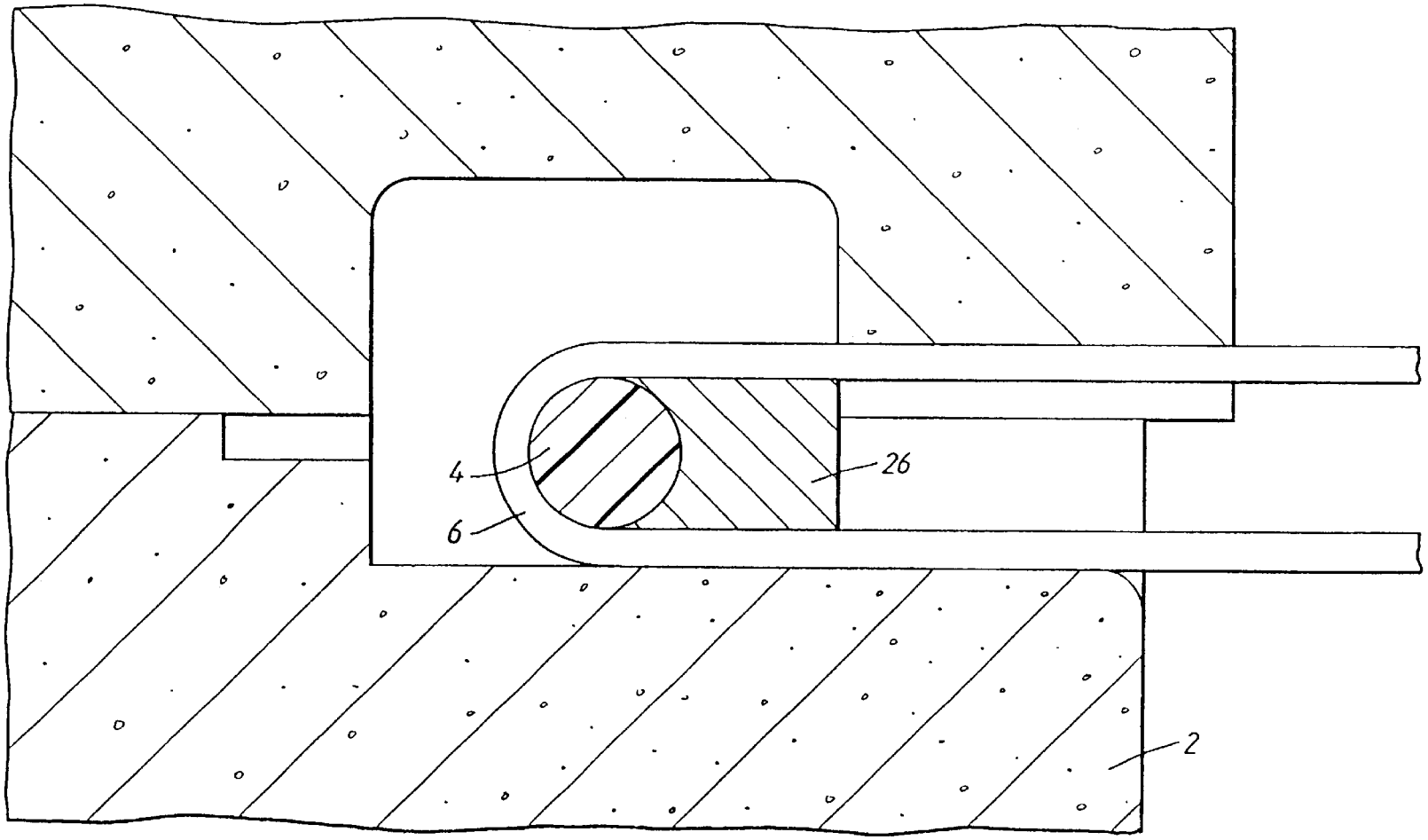
FIG. 3 is an enlarged sectional view similar to that of FIG. 1 and along the line 3—3 in FIG. 2 in the assembly.
Figure 6:
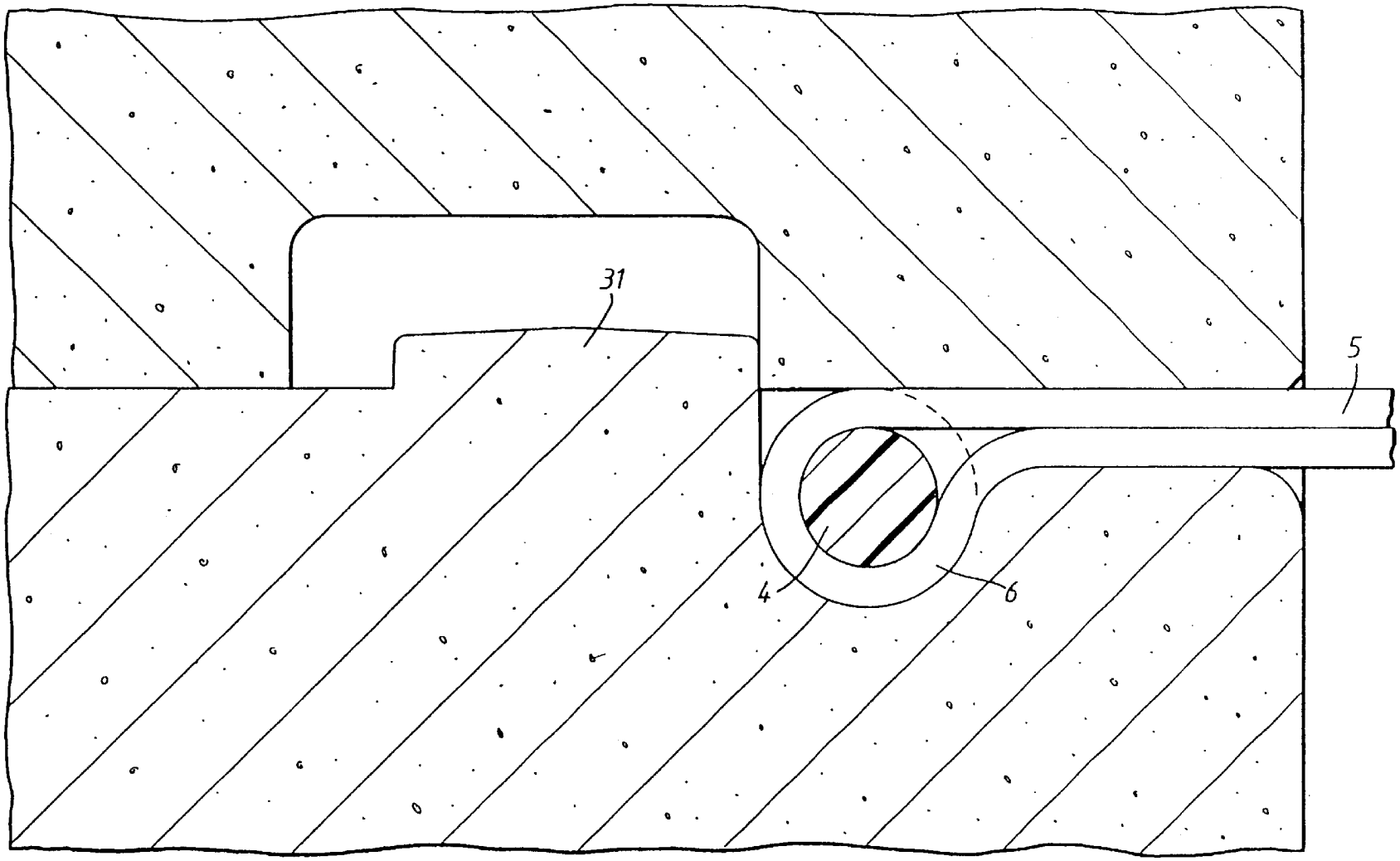
Figure 7:
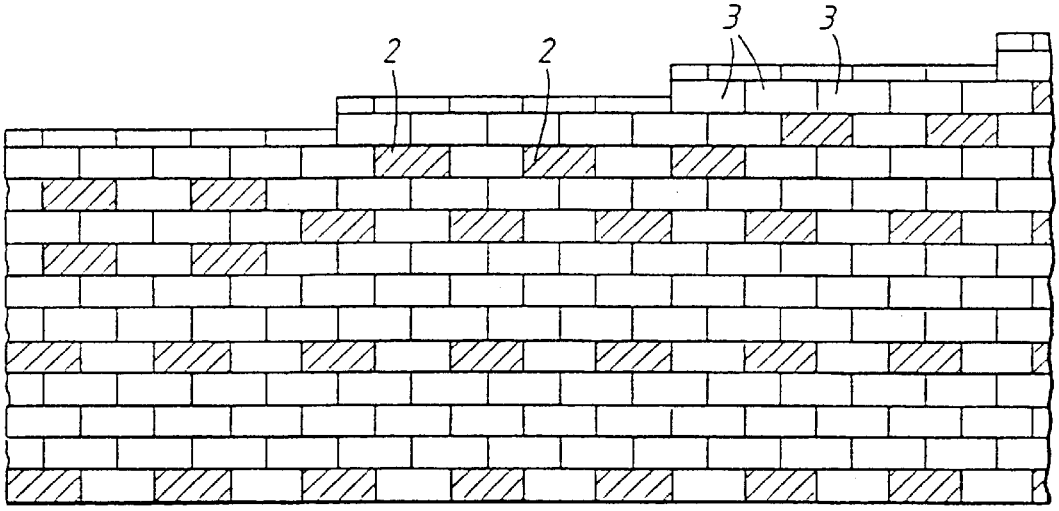
FIG. 7 is a front view of a facing incorporating assemblies according to the invention.
Figure 8:
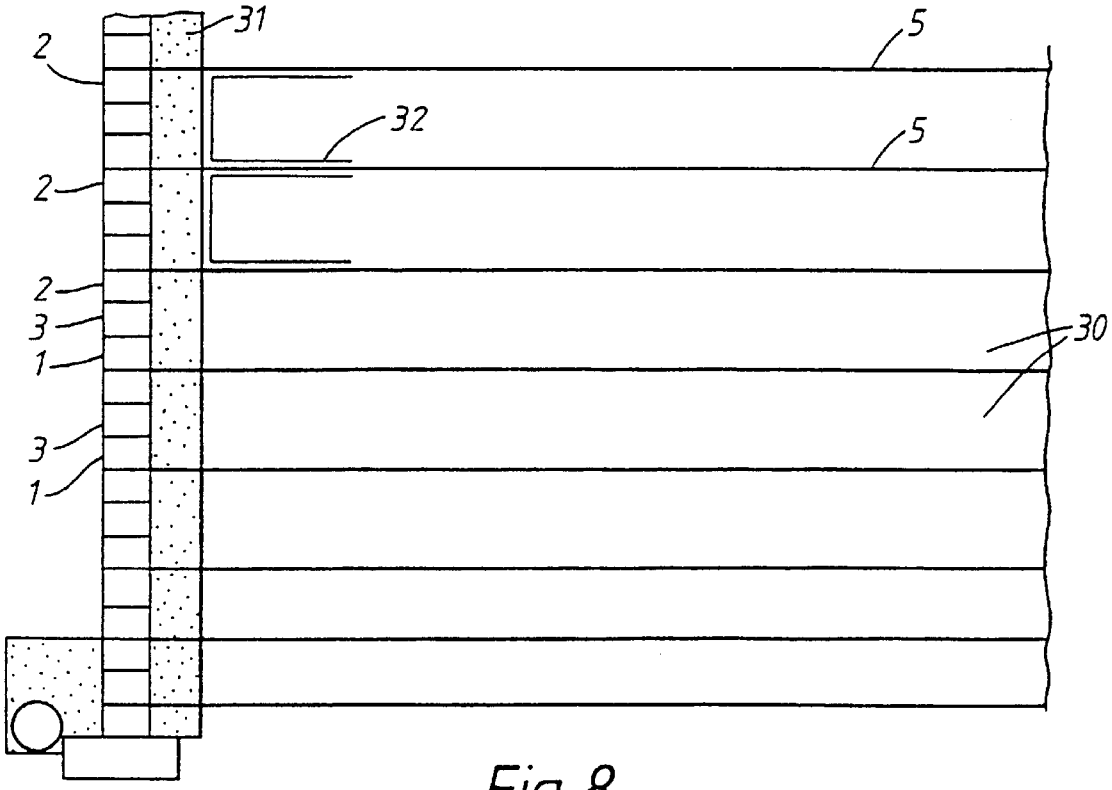
FIG. 8 is an illustrative sectional side view of the facing shown in FIG. 6.

The second recess may be defined by a pair of confronting troughs in the two blocks like the first recess (see FIG. 3). In a preferred embodiment the first and second recesses are defined solely by troughs in the lower block 2 (see FIG. 6).

The first recess 11 receives the rod with circumflected strip with the ends of rod 4 extending laterally to either side of the second recess 12. The ends of the rod 4 confront and abut a part of the wall of the first recess 11 to retain the rod and thereby the strip 5 within the cavity 7. The internal location of the rod helps to distribute horizontally and vertically the load applied to the facing 10 by the strip 6 through the rod 4.

In a preferred embodiment (FIG. 6) the first recess 11 has a greater depth than the second recess 12 to form a lip 17. The floor of the recess 11 is concave to match the shape of the circumflected portion 6 of the strip 5, and the lip is smoothly curved to connect the recesses 11,12. Under load the portion of the strip 5 abuts in close fitting relation the curved lip 17 to support the rod 4 along substantially its entire length so that the rod 4 is retained behind the lip 17 and the bending moment on the rod 4 is considerably reduced.

Figure 5:
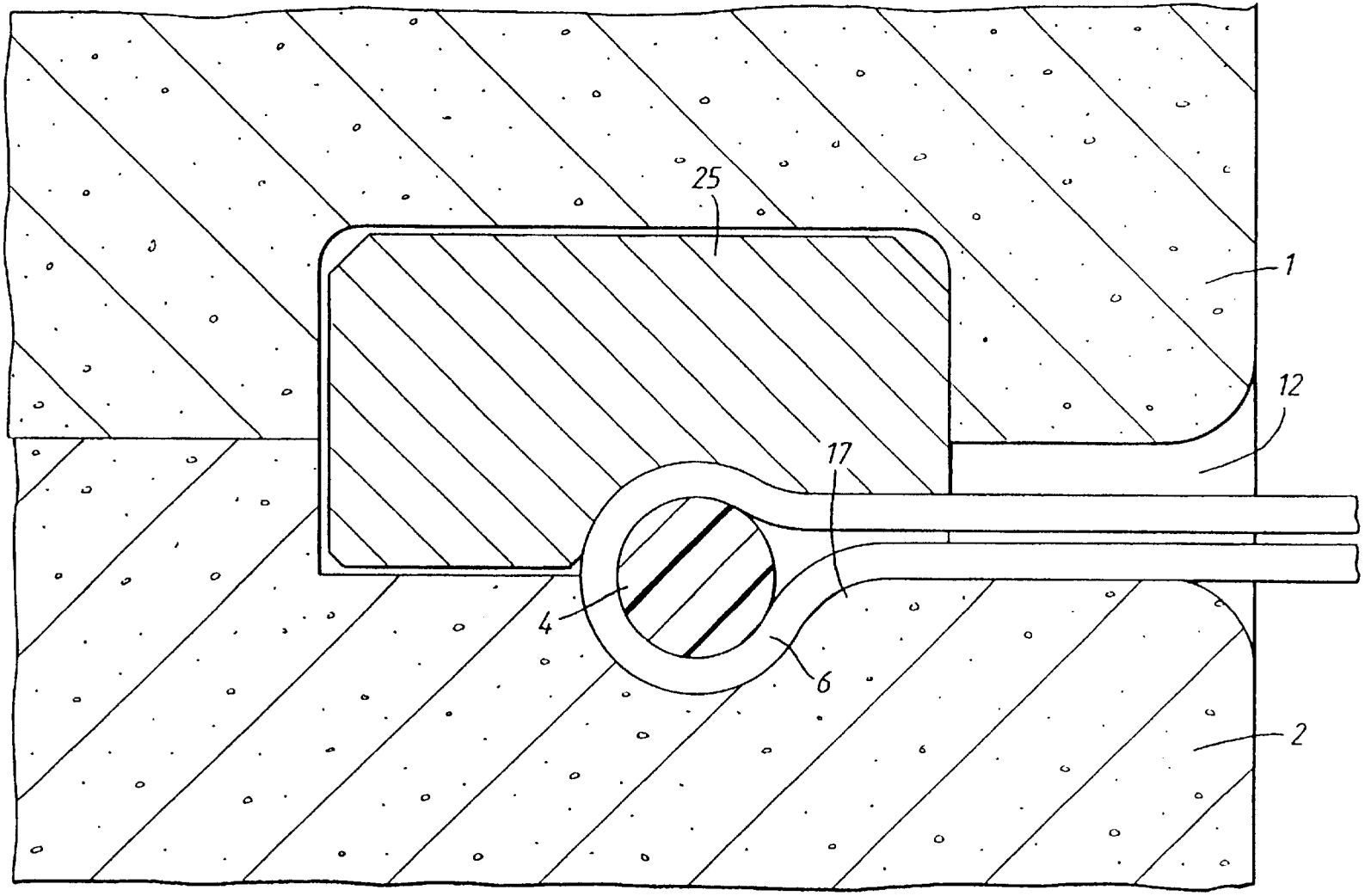

A connecting means in the form of a connecting insert 25, moulded to fit closely the walls of the recess 11 and the upper surface of the strip 5 within the recess 11, can be located in and extend laterally along the length of the recess (FIG. 5). Alternatively, the connecting means could be formed integrally with one of the blocks (1,2) by an abutment 31 protruding into a complementary trough in the adjacent block (see FIG. 6). In the embodiment utilising an insert 25, the insert holds the rod 4 down so that it remains behind the lip 17. The connecting means interlinks the blocks 1,2 functioning as a shear key to reinforce the facing 10 and to distribute loads imposed on the facing 10. The connecting means also aids accurate location of the blocks when the facing is being constructed.

Figure 4:
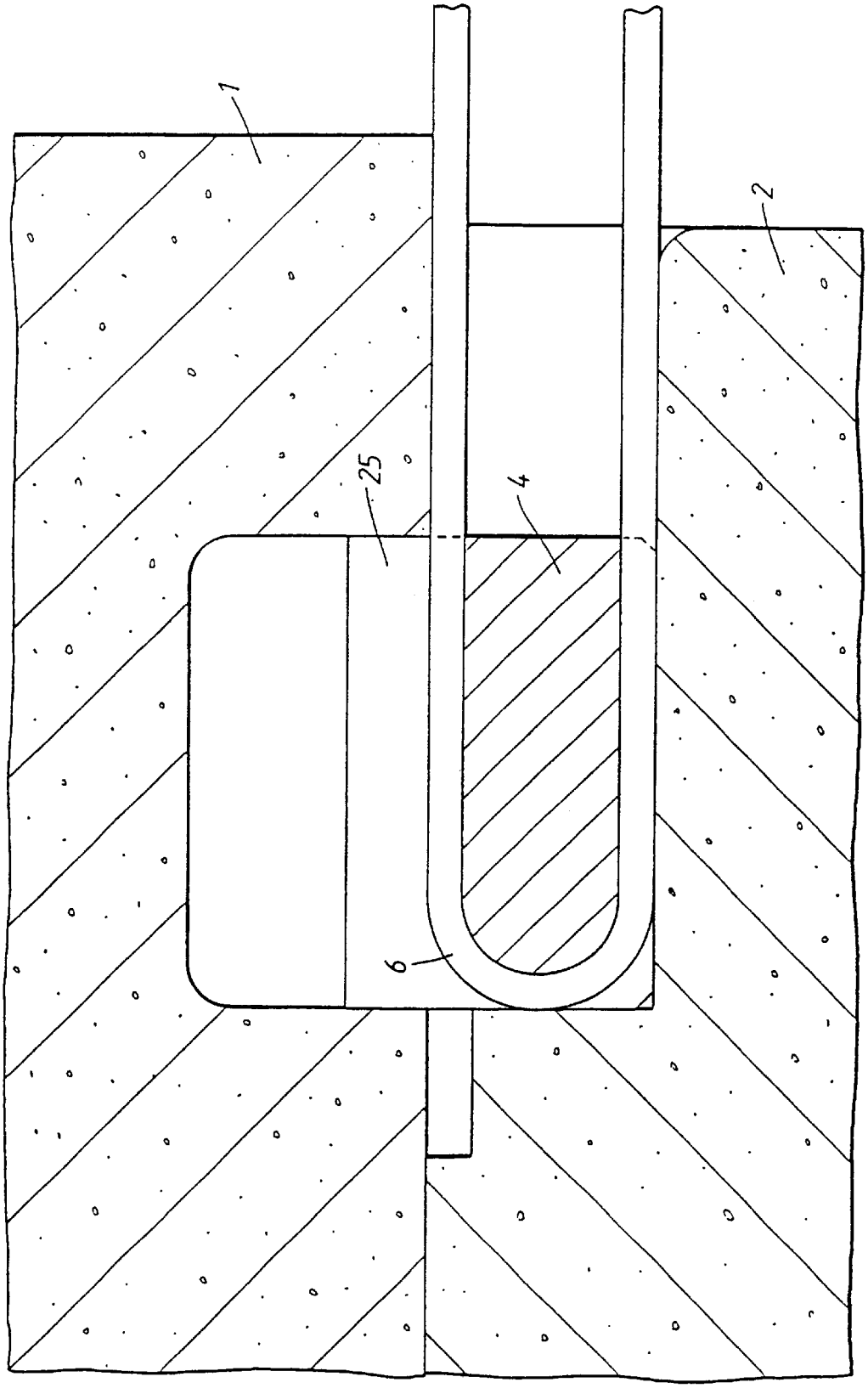
FIGS. 4, 5 and 6 are views similar to that of FIG. 3 showing alternative embodiments of the invention.

In the embodiments illustrated in FIGS. 3 and 4, the floors of the recesses 11,12 are flush and the forces imposed on each rod are reacted by its laterally projecting ends. A strut 26 may be disposed interjacent the rod 4 and the rear face of the recess 11 (see FIG. 3) to strengthen the rod 4 which is subject to increased bending forces due to the absence of support for its central portion. Alternatively, the rod 4 and strut 26 may be formed integrally (see FIG. 4). Further the lateral ends of the strut 26 may also abut the front and rear faces of the trough in the upper block 1 to function as a shear key.

The rod 4, the connecting insert 25 or the strut 26 could be formed from polypropylene, polyethylene, glass-filled polyethylene, or any other suitable plastics. Alternatively, the rod, insert or strut could be formed from, e.g. ceramics, a carbon fibre composite material, or a metallic material.

During construction of a reinforced soil structure, the facing 10 and soil, e.g. compacted granular fill (30), are built up in layers. Assemblies according to the invention are interspersed with intermediate blocks to form an coherent structure. As blocks of adjacent rows of blocks are laterally offset, the recesses are formed in two abutting blocks in the same row, thereby utilising three blocks to define the cavity 7. A drainage layer 31 may be provided immediately behind the facing 10, and a geotextile strip 32 may be disposed between the granular fill 30 and the drainage layer 31 to prevent particles from the fill clogging up the drainage layer.

The projections 8 and/or complementary recesses may be arranged such that successive rows of blocks are offset rearwardly to form a generally reclined facing. A reclined facing is particularly advantageous in relatively small structures. The facing may be inclined at an angle of between 5 to 15° to the vertical, and is preferably inclined at an angle of about 9°.

Figure 9:
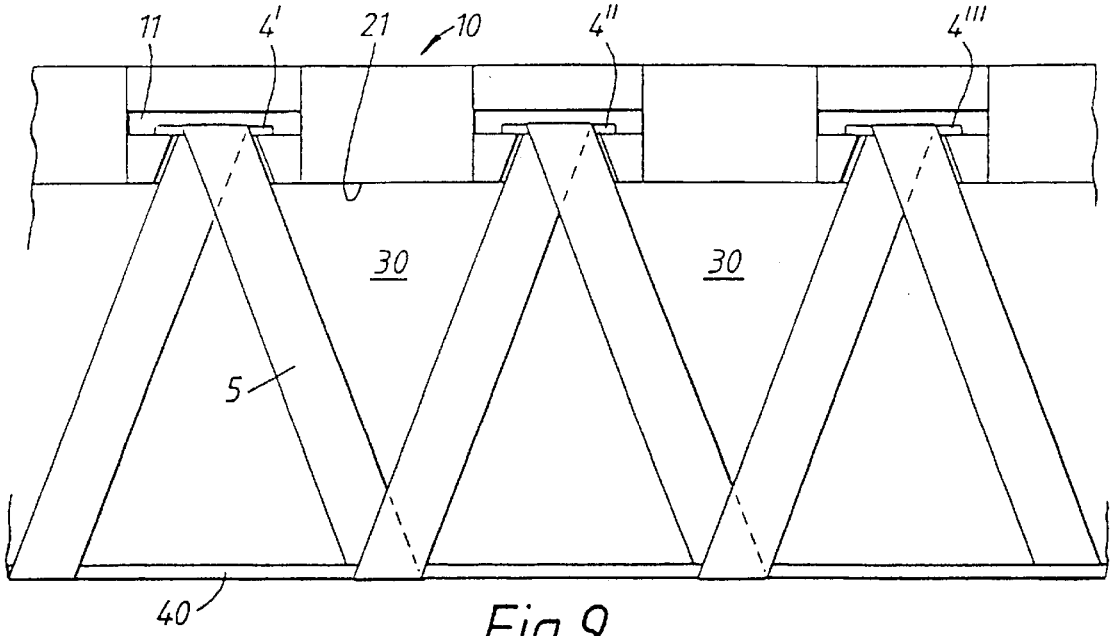
FIG. 9 is an illustrative cross-sectional plan view of a facing.

One or more anchoring bars or shafts 40 are disposed in the soil behind the facing on the same horizontal level as the row of assemblies according to the invention. A continuous portion of strip 5 is circumflected about a rod 4', a bar 40, a rod 4" adjacent to the rod 4' etc., to produce a zigzag-shaped path as illustrated in FIG. 9. The inclination of the strip 5 relative to the facing 10 is exaggerated for ease of illustration; in reality the anchoring bar or bars 40 are disposed a greater relative distance from the rear of the facing 21.

Figure 10:
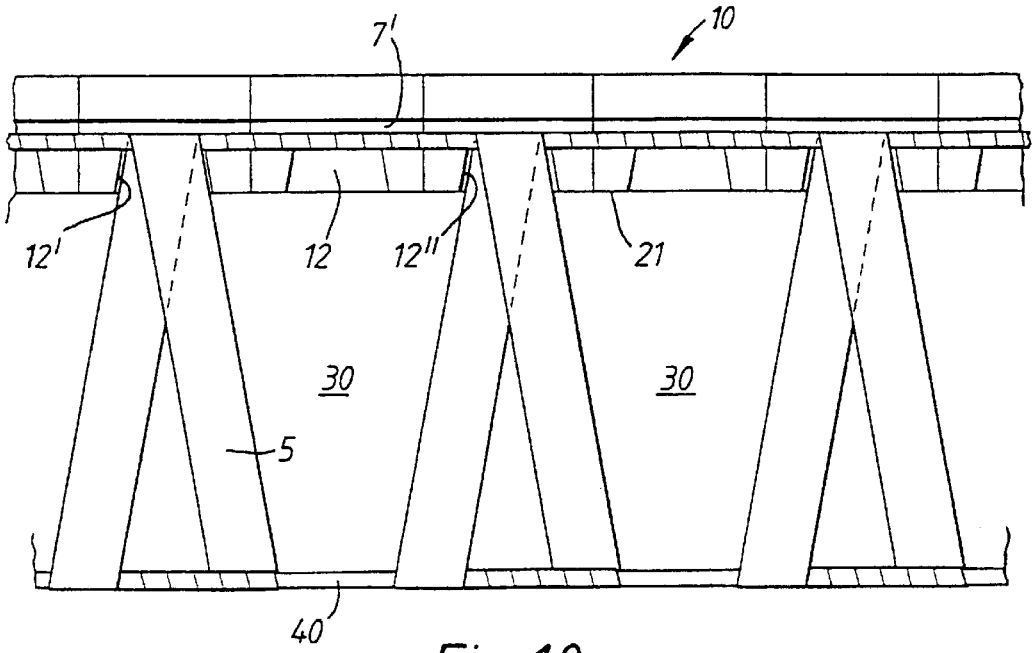
FIG. 10 is a similar view to that of FIG. 8 showing a preferred configuration.

In a preferred configuration, illustrated in FIG. 10, a plurality of blocks 1 are juxtaposed to define an extended lateral cavity 7' and one or more rods 4 extend along the length of the extended cavity 7'. A continuous strip 5 is wound along the length of the or each rod 4, and at regular intervals it is passed out of the facing through a recess 12, circumflected about an anchoring bar 40 and returned to the rod 4 through the same recess 12. The strip may be wound along the anchoring bar 40 before it is passed back to the rod 4, thereby to define a distinct vee-shape. The blocks used to define the extended cavity 7' may be of an identical configuration, or spacing blocks without a second recess may be utilised. By winding the strip 6 along the length of the or each rod 4 the connection between the blocks and the strip is strengthened.

Of course, modifications to the described embodiments of the invention may be made without departing from the scope of the claims. For instance, the extended lateral cavity could span the length of the facing, or a number of discrete extended cavities could be provided.

What is claimed is:

1. An assembly for use in reinforcing a soil structure comprising a polymeric strip secured to a facing by attachment means, the facing comprising a multitude of blocks and the attachment means comprising a plurality of elongate attachment members, each of said plurality of attachment members being received and retained in a cavity defined by a grouping of at least two said blocks, a connecting member housed in each cavity serving to interlink said groups of blocks, and the strip being circumflected alternately about one of said attachment members and an anchoring member disposed in the soil structure.

2. An assembly according to claim 1, wherein the attachment member and the connecting means are integrally formed.

3. An assembly according to claim 1, wherein at least one cavity comprises a first recess disposed substantially orthogonally to a second recess, and the second recess extends between the first recess and rear faces of the blocks adjacent the soil structure.

4. An assembly according to claim 3, wherein the first recess is arranged laterally of the blocks.

5. An assembly according to claim 3, wherein the second recess is arranged centrally of the blocks.

6. An assembly according to claim 1, wherein a depth of the first recess is greater than depth of the second recess to define a lip therebetween.

7. An assembly according to claim 6, wherein the lip supports the adjacent portion of the attachment member to reduce substantially a bending moment imposed by the strip on the attachment member.

8. An assembly according to claim 1, wherein the attachment member is formed from a non-metallic material.

9. A method of securing a polymeric strip of a reinforced soil structure to a facing therefore comprising a multitude of blocks, and including the steps of providing a plurality of elongate attachment members and a plurality of connecting members, circumflecting said strip alternately about one of said attachment members and an anchoring member disposed in the soil structure, wherein a group of said multitude of blocks defines a plurality of cavities, each cavity receiving one of said attachment members, a portion of the circumflected strip and one of said connecting members, the group of blocks serving to sandwich the respective attachment member, the portion of the circumflected strip and connecting member in the cavity thereby to secure the strip to the facing and to interlink the blocks.

* * * * *